United States Patent [19]

Weinberg et al.

[11] Patent Number: 4,555,025

[45] Date of Patent: Nov. 26, 1985

[54] SHRINK BAG WITH INTEGRAL HANDLE

[75] Inventors: Alan S. Weinberg, Greenville; B. Gary Wofford, Spartanburg, both of S.C.; Philip T. Voso, Tryon, N.C.

[73] Assignee: W. R. Grace & Co., Cryovac Div., Duncan, S.C.

[21] Appl. No.: 733,405

[22] Filed: Mar. 13, 1985

Related U.S. Application Data

[63] Continuation of Ser. No. 510,108, Jul. 1, 1983, abandoned.

[51] Int. Cl.[4] ..... B65D 30/02; B65D 33/02; B65D 33/08

[52] U.S. Cl. ..... 206/497; 53/413; 53/442; 383/10; 383/66

[58] Field of Search ..... 206/497; 383/7, 9, 10, 383/87, 903, 908, 25, 66; 53/413, 441, 442; 493/224

[56] References Cited

U.S. PATENT DOCUMENTS

| | | | |
|---|---|---|---|
| Re. 26,674 | 9/1969 | Ilg | 383/9 |
| 3,066,845 | 12/1962 | Mattaway | 383/9 |
| 3,358,906 | 12/1967 | Faiers | 383/87 |
| 3,549,085 | 12/1970 | Hart . | |
| 3,650,775 | 3/1972 | Simon | 206/497 |
| 3,670,947 | 6/1972 | Tangredi et al. . | |
| 3,741,253 | 6/1973 | Brax et al. . | |
| 3,815,313 | 6/1974 | Heisler | 53/413 |
| 3,863,837 | 2/1975 | Spiegel et al. | 206/497 |

FOREIGN PATENT DOCUMENTS

| | | | |
|---|---|---|---|
| 1470957 | 1/1967 | France | 383/10 |
| 1150368 | 4/1969 | United Kingdom | 383/10 |
| 1396290 | 6/1975 | United Kingdom | 383/10 |

*Primary Examiner*—Stephen P. Garbe

*Attorney, Agent, or Firm*—John J. Toney; William D. Lee, Jr.; Mark B. Quatt

[57] ABSTRACT

A shrink bag having an integral carrying handle is provided that includes an extended lip bag of a heat shrinkable thermoplastic material and having a carrying hole in the lip with a continuous fused bead around its periphery, the carrying hole being spaced sufficiently below the top of the lip such that upon heat shrinking the bag about a product sealed therein enhanced thickening along the carrying-load bearing portion of the hole periphery occurs relative to the non-load bearing portion of the hole periphery. An associated method for making the bag is also provided.

10 Claims, 3 Drawing Figures

SHRINK BAG WITH INTEGRAL HANDLE

This application is a continuation of application Ser. No. 510,108 filed on 7/1/83, now abandoned

BACKGROUND OF THE INVENTION

This invention relates generally to a thermoplastic packaging bag having a carrying handle and relates specifically to a heat shrinkable packaging bag having an integral carrying handle.

In the vacuum packaging of food products in heat-shrinkable thermoplastic bags a product is first placed inside the bag, the bag is vacuumized, then the bag mouth is sealed while still under vacuum, and finally the bag is heat shrunk about the contained product to form an attractive vacuum package. It is frequently inconvenient to handle relatively heavy food products, such as whole turkey, packaged in the foregoing manner, especially when frozen. Thus, it is desirable that means for carrying such packages be provided with the package.

Various approaches have been taken in providing packaging bags with means for carrying, such as by attachment of a handle to the package or by cutting a carrying hole in a flap portion at the bag mouth and reinforcing the periphery of the hole with a grommet to inhibit tear initiation under carrying or hanging load.

For reasons of economy in manufacturing bags suitable for vacuum-shrink packaging, it would be desirable to provide package carrying means as an intregal part of the bag construction without the addition of a separate carrying handle or a separate reinforcement device in conjunction with a carrying hole cutout.

SUMMARY OF THE INVENTION

It is a primary object of the invention to provide a heat shrinkable thermoplastic packaging bag having a carrying hole with integral reinforcement provided incidental to bag manufacture.

Accordingly, there is provided a shrink bag having an integral carrying handle, comprising an extended lip bag of a heat shrinkable thermoplastic material and having a carrying hole in said lip with a continuous fused bead around the periphery thereof, said carrying hole being spaced sufficiently below the top of said lip such that upon heat shrinking said bag about a product sealed therein enhanced thickening along the carrying-load bearing portion of said hole periphery occurs relative to the non-load bearing portion of said hole periphery.

Additionally, there is provided a method for making a shrink bag having an integral carrying handle, comprising providing an extended lip bag of a heat shrinkable thermoplastic material; and heat cutting a carrying hole in said lip to form a continuous fused bead around the periphery thereof, said carrying hole being spaced sufficiently below the top of said lip such that upon heat shrinking said bag about a product sealed therein enhanced thickening along the carrying-load bearing portion of said hole periphery occurs relative to the non-load bearing portion of said hole periphery.

BRIEF DESCRIPTION OF THE DRAWINGS

Further details are given below with reference to the drawings wherein.

DESCRIPTION OF THE PREFERRED EMBODIMENTS

Figure 1:
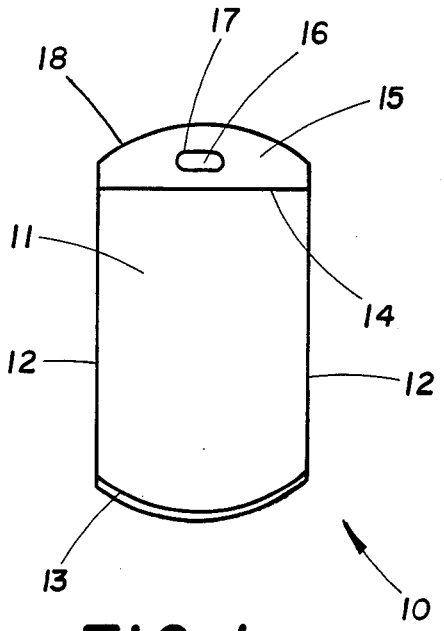
FIG. 1 is a schematic front view of a heat shrinkable extended lip bag having a carrying hole in the extended lip, as the bag would appear prior to heat shrinkage about a contained product; p FIG. 2 schematically depicts the foregoing bag following heat shrinkage about a product vacuum sealed therein.

In FIG. 1, there is shown bag 10, according to one mode of the invention, which has been formed by end sealing lay-flat tubular film. Bag 10 is shown prior to loading and vacuum sealing a product therein. Bag 10 has product-containing envelope 11 with seamless sides 12 as results from collapsing tubular film to a lay-flat configuration in conventional manner. It is required that bag 10 be constructed of heat shrinkable thermoplastic packaging film. For example, the film may be an oriented barrier film having low oxygen permeability such as that disclosed in U.S. Pat. No. 3,741,253. The lay-flat tubing is heat sealed at 13 to form the bag bottom. The opposite end of the bag is left open to form a bag mouth at 14. Further as shown, the front panel of the bag has been trimmed along mouth 14 such that the front bag panel is shorter than the rear bag panel thereby forming extended lip 15 which is the extended portion of the rear bag panel. This type of bag is generally referred to as an extended lip bag. Alternatively, the extended lip bag may be of the side-sealed type.

According to the invention, a carrying hole 16 is formed in extended lip 15 by heat cutting so that simultaneously with formation of carrying hole 16 there is formed a continuous fused bead 17 around the periphery of carrying hole 16. The purpose of the continuous fused bead is to inhibit tear initiation upon carrying the bag when loaded using carrying hole 16. Heat cutting may be accomplished with a punch heated sufficiently so that said fused bead forms upon cutting. The reason for the requirement that the bag have an extended lip is that otherwise the bag panels would fuse together during heat cutting thereby essentially closing the mouth of the bag. The upper edge 18 of extended lip 15 has been selectively trimmed to provide a selected shape of lip 15 following heat shrinkage of the bag, as discussed below, after vacuum sealing a product therein. Further, the spacing of carrying hole 16 below the upper edge 18 of lip 15 is sufficient for carrying reinforcement of lip 15 upon heat shrinkage, as further discussed below.

Figure 2:
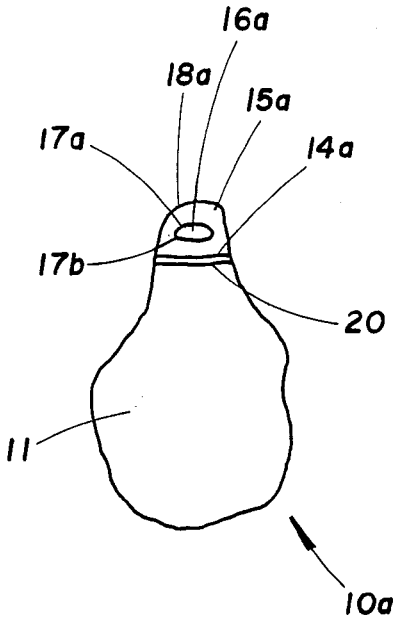

In FIG. 2, package 10*a* is formed by vacuum sealing a product in bag 10, and then heat shrinking the bag securely about the contained product. For example, the package may be formed by placing a whole turkey in envelope 11 through mouth 14 of bag 10, followed by vacuumizing envelope 11 and, while still under vacuum, heat sealing the bag mouth as indicated at 20. Alternatively, bag closure may be by conventional gathering and clipping of the bag mouth while under vacuum. The vacuum sealed bag is then heat shrunk over the contained product from which results the altered and reinforced configuration of extended lip 15 so that shrunken extended lip 15*a* in conjunction with carrying hole 16*a* forms a reinforced bag handle to facilitate handling of package 10*a*. Reinforcement arises incidental to heat shrinkage of the package by the occurrence of differential shrinkage along the upper and lower portions of the periphery of carrying hole 16*a* as indicated at 17*a,b* respectively. Heat shrinkage in the film above carrying hole 16 is essentially free-shrinkage (unrestrained) in comparison to shrinkage below the carrying hole which is restrained-shrinkage due to its proximity to heat seal 20 and the semirigid product contained in envelope 11. As a result of this free-shrinkage, enhanced thickening occurs along peripheral portion 17*a* of carrying hole 16*a* relative to the lower peripheral portion 17*b*. When carrying package 10*a* using carrying hole 16*a*, upper peripheral portion 17*a* thus will be the load bearing portion while segment 17*b* will be substantially non-load bearing. This relative thickening thus provides reinforcement of extended lip 15*a* under carrying load.

The upper edge 18*a* of extended lip 15*a*, as mentioned above, has optionally been trimmed in a predetermined manner so that upon heat shrinkage of package 10*a* extended lip 15*a* assumes a neatly rounded appearance. Further, by contouring the lip edge to generally correspond to the curvature of the carrying hole, free-shrink is enhanced in the film region above the carrying hole.

In the foregoing manner, an integral reinforced carrying handle is obtained incidental to bag manufacture and utilization, without the addition of separate handle or reinforcement means. Reinforcement of the bag handle is attributable to two aspects. First, carrying hole 16 is heat cut thereby forming a continuous fused bead around the periphery of the carrying hole, the fused bead serving to inhibit tear initiation of the extended lip of the bag under carrying load. Second, by sufficiently spacing the carrying hole below the top edge of the extended lip, enhanced thickening along the carrying-load bearing or upper peripheral portion of carrying hole 16 occurs during heat shrinkage of the vacuum sealed package.

Optionally, to further enhance the shrinkage reinforcement effect, the heated conventional cutting tool (generally similar to a hollow cylinder) used to heat cut the carrying hole may be modified by the provision of a heated band that circumscribes the cutting tool and arranged so as to abut the film region around the cutout at the end of travel of the cutting tool. This arrangement causes a preliminary shrink treatment of the film region around the cutout for enhanced film thickening.

Figure 3:
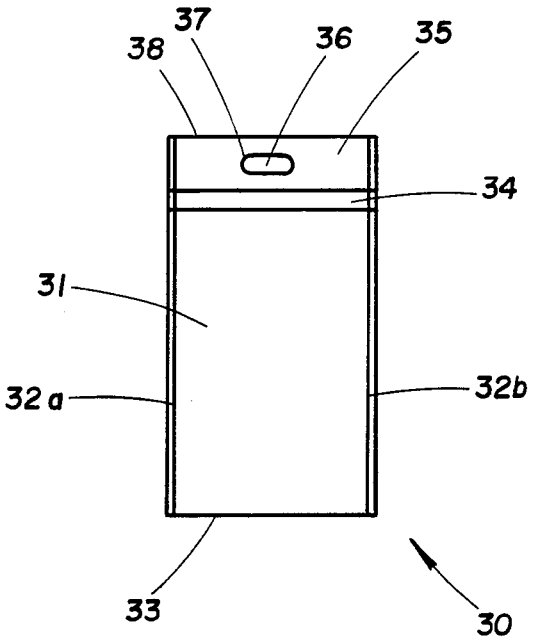
FIG. 3 depicts an alternative embodiment being similar to FIG. 1 but utilizing a double thickness extended lip bag.

In FIG. 3, there is shown an alternative bag being similar to that of FIG. 1 but differing primarily in that bag 30 is a double thickness extended lip bag. Bag 30 is formed by heat side-sealing collapsed tubular film at side seals 32*a,b* to delimit envelope 31 above seamless bottom 33. Prior to side-sealing, a transverse strip is removed from one face of the lay-flat tubing which will eventually be the front bag panel having mouth opening 34. Incidental to forming mouth 34, double thickness extended lip 35 is formed. As above, carrying hole 36 is heat cut in double thickness extended lip 35 so as to form a continuous fused bead around the periphery 37 of hole 36, further provided that hole 36 is spaced sufficiently below the top edge 38 of lip 35 to promote the free-shrinkage effect as discussed above for handle reinforcement. Additionally, another reinforcing feature results in this embodiment upon heat cutting hole 36 in that the fused bead around the periphery 37 of hole 36 tends to fuse the front and back panels of the double thickness extended lip 35 in the vicinity of the fused bead. Bag 30 is then utilized as discussed above whereby a food product is vacuum sealed therein (the heat seal being just below mouth 34), followed by heat shrinking treatment from which results the relatively free-shrinkage around periphery 37 of carrying hole 36.

As an example, to demonstrate the interactive aspects of the invention, strength tests were conducted on 3 sets of oriented strips of film of the type referred to above, each strip having a hang hole toward one end formed under varying conditions. In set A, fully in accordance with the invention, the hand holes were hot cut with a punch heated to about 300° F., and then the film strips were heat-shrunk in a water bath at about 200° F. for 2–3 seconds. In set B, the film strips were preshrunk under the above bath conditions, and then the hang holes were hot-cut as above. In set C the strips were preshrunk under the above bath conditions, and then the hang holes were cut with a punch at room temperature. Under hanging load, the ultimate stress sustained by set A (hot-cut, then shrunk) was about 14–15% greater than that of set B (shrunk, then hot-cut) which demonstrates the free-shrinkage reinforcement effect, i.e. the film region around the hole shrinks substantially unrestrained as though it were at an outside edge of the film. The ultimate stress sustained by set B (shrunk, then hot-cut) was about 26–29% greater than that of set C (shrunk, then cold-cut) which demonstrates the fused bead reinforcement effect. Overall, set A was about 44–48% stronger than set C, set A roughly corresponding to the invention and set C roughly corresponding to conventional practice.

Although the present invention has been described in conjunction with preferred embodiments, it is to be understood that modifications and variations may be utilized without departing from the principles and scope of the invention, as those skilled in the art will readily understand. Accordingly, such modifications and variations may be practiced within the scope of the following claims:

What is claimed is:

1. A shrink bag comprising an integral carrying handle, a rear bag panel, a corresponding front bag panel which is shorter than the rear bag panel, the front and rear bag panel forming an extended lip bag of a heat shrinkable thermoplastic material and having an unsealed bag mouth at one end of said bag and a carrying hole in said lip with a continuous fused bead around the periphery of said hole, said carrying hole being spaced sufficiently below a top of said lip such that upon heat shrinking said bag about a product sealed therein enhanced thickening along a load-bearing portion of said hole periphery occurs relative to a non load-bearing portion of said hole periphery.

2. The bag of claim 1 wherein the extended lip of said bag is a single-thickness extended lip.

3. The bag of claim 2 wherein said bag is a side-sealed bag of seamless tubular film.

4. The bag of claim 1 wherein the extended lip of said bag is a double-thickness extended lip.

5. The bag of claim 4 wherein said bag is a side-sealed bag of seamless tubular film.

6. The bag of claim 1 wherein a top edge of the extended lip is selectively contoured substantially corresponding to a curvature of said carrying hole.

7. A method for making a shrink bag having an integral carrying handle, comprising providing a rear bag panel, corresponding front bag panel which is shorter than the rear bag panel, the front and rear bag panel forming an extended lip bag of a heat shrinkable thermoplastic material and having an unsealed bag mouth at one end of said bag; and heat cutting a carrying hole in said lip to form a continuous fused bead around the periphery of said hole, said carrying hole being spaced sufficiently below a top of said lip such that upon heat shrinking said bag about a product sealed therein enhanced thickening along a load-bearing portion of said hole periphery occurs relative to a non load-bearing portion of said hole periphery.

8. The method of claim 7 wherein said extended lip bag is provided as a double thickness extended lip bag formed from side-sealed lay-flat seamless tubular film with a strip removed from one side of the lay-flat tubular film transverse to the side-seals.

9. The method of claim 7 further comprising selectively contouring a top edge of the extended lip to generally correspond to a curvature of said carrying hole.

10. The method of claim 7 further comprising partially shrinking the film around said carrying hole simultaneously with heat cutting said hole.

* * * * *